US007217169B1

(12) United States Patent
Anderson

(10) Patent No.: US 7,217,169 B1
(45) Date of Patent: May 15, 2007

(54) DIMENSIONALLY STABLE FLYING DISC TOY CONSTRUCTION

(75) Inventor: Dennis C. Anderson, Northfield, MN (US)

(73) Assignee: National Polymers LLC, Lakeville, MN (US)

( * ) Notice: Subject to any disclaimer, the term of this patent is extended or adjusted under 35 U.S.C. 154(b) by 151 days.

(21) Appl. No.: 11/155,715

(22) Filed: Jun. 18, 2005

(51) Int. Cl.
*A63H 27/00* (2006.01)

(52) U.S. Cl. ..... 446/46; 473/588

(58) Field of Classification Search ..... 446/46, 446/47, 48; 473/588, 589, 590; 119/707; D21/443, 444
See application file for complete search history.

(56) References Cited

U.S. PATENT DOCUMENTS 3,359,678 A 12/1967 Headrick
3,571,811 A 3/1971 Wilson
3,850,341 A * 11/1974 Bart ..... 220/212
4,212,131 A 7/1980 Ross
4,378,653 A 4/1983 O Brien
4,516,947 A 5/1985 Pircher et al.
D326,121 S 5/1992 Asner
5,480,334 A * 1/1996 Wilson et al. ..... 446/46
5,484,159 A * 1/1996 Dean et al. ..... 473/588
7,096,826 B2 * 8/2006 Markham ..... 119/707

* cited by examiner

*Primary Examiner*—Nini F. Legesse
(74) *Attorney, Agent, or Firm*—James V. Harmon

(57) ABSTRACT

A flying disc toy formed from plastic resin includes a circular central body portion surrounded by a circular rim that has a stair-step cross-sectional configuration. The rim includes an upper step and a lower step that extends outwardly therefrom. Each step has a circular horizontal tread portion and an upright annular riser portion at right angles to one another. An inner surface of the lower riser is dimensioned to form a sliding fit over an outer surface of the upper riser of a similar disc that is positioned beneath it when the discs are placed in a stack.

9 Claims, 2 Drawing Sheets

DIMENSIONALLY STABLE FLYING DISC TOY CONSTRUCTION

FIELD OF THE INVENTION

This invention relates to flying toys and more particularly to a dimensionally stable flying disc toy.

BACKGROUND OF THE INVENTION

Several disc shaped flying toys have been previously proposed as described, for example, in the following patents: Des. 329,121; U.S. Pat. Nos. 4,516,947; 3,359,678; 3,571,811; 4,212,131; and 4,378,653.

Flying toys of this kind have two general purposes; the entertainment of people and dogs, and to serve as an advertising medium. However, in manufacturing prior products of this kind, certain problems were encountered. The products were difficult to stack so that when put on top of one another for placement in boxes they did not form a stable stack. This made handling and packaging difficult and reduced the number of discs that could be placed in each box. In addition, when the discs were hot following removal from the forming dies, they were subject to distortion or warpage. Prior to developing the present invention, several flat tables were tried to support the hot discs just removed from molding dies in an attempt to allow them to harden without distortion. Placing them on the tables was time consuming and labor intensive. Advertising material printed on prior discs was also often of non-uniform or of uneven quality due to the surface distortion previously encountered.

In view of these and other deficiencies of the prior art, it is one object of the present invention to provide a flying disc toy of the type described that can be made dimensionally distortion free to thereby enhance flight characteristics and prevent printing problems.

Another object is to provide a flying disc toy having a distortion resistant feature for stabilizing the dimensions of the toy while at the same time maintaining or enhancing its aerodynamic flight characteristics.

Another object of the invention is to provide a flying disc toy that has a substantially uniform cross-sectional thickness throughout without enlarged or thickened portions which require additional resin.

Another object is to find a way to enable a toy of the type described to be removed from molds in a hot condition and be self-regulating with respect to maintaining dimensions and preventing distortion during the cooling process.

Yet another object of the invention is to provide an improved flying disc toy that requires no supporting fixtures during the cooling step after being withdrawn from molding dies and wherein a smaller carton than previously required can be used for the same number of discs.

These and other more detailed and specific objects of the present invention will be better understood by reference to the following Figures and detailed description which illustrate by way of example but a few of the various forms of the invention within the scope of the appended claims.

A BRIEF DESCRIPTION OF THE FIGURES

BRIEF SUMMARY OF THE INVENTION

Briefly, the invention provides a flying disc toy formed from plastic resin which includes a circular central body portion surrounded by a circular rim that has a stair-step cross-sectional configuration. The rim includes an upper step and a lower step that extends outwardly therefrom. Each step has a circular horizontal tread portion and an upright annular riser portion at right angles to one another. An inner surface of the lower riser is dimensioned to form a sliding fit over an outer surface of the upper riser of a similar disc that is positioned beneath it when the discs are placed in a stack.

DETAILED DESCRIPTION OF THE INVENTION

Figure 1:
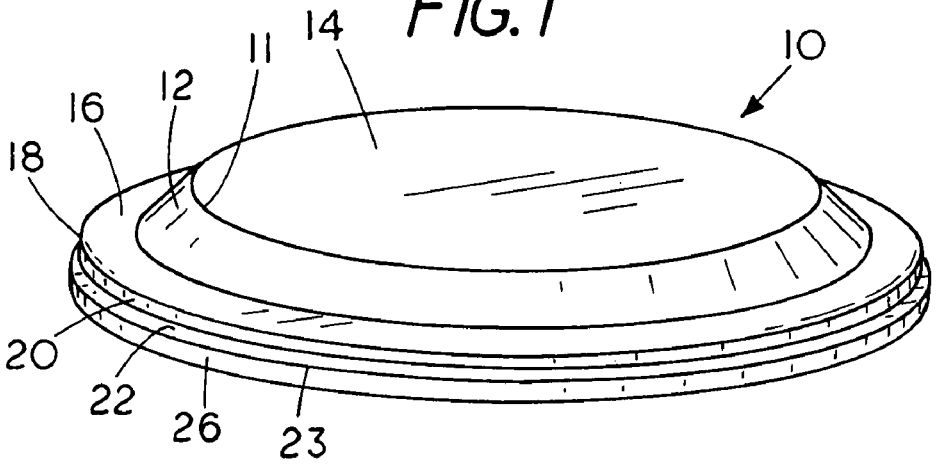
FIG. 1 is a perspective view of the invention as seen from above.
Figure 2:
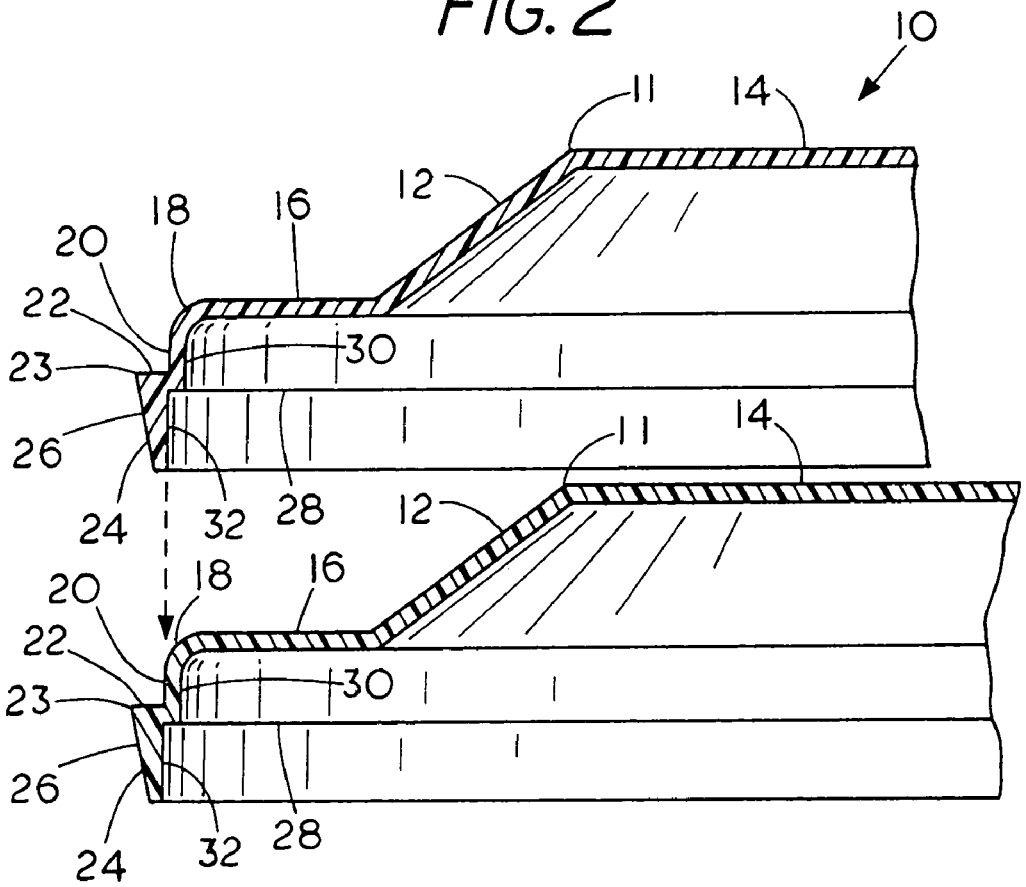
FIG. 2 is a vertical cross sectional view of two disc toys in accordance with the invention on a larger scale than in FIG. 1 as seen just before being placed together in a stack.
Figure 3:
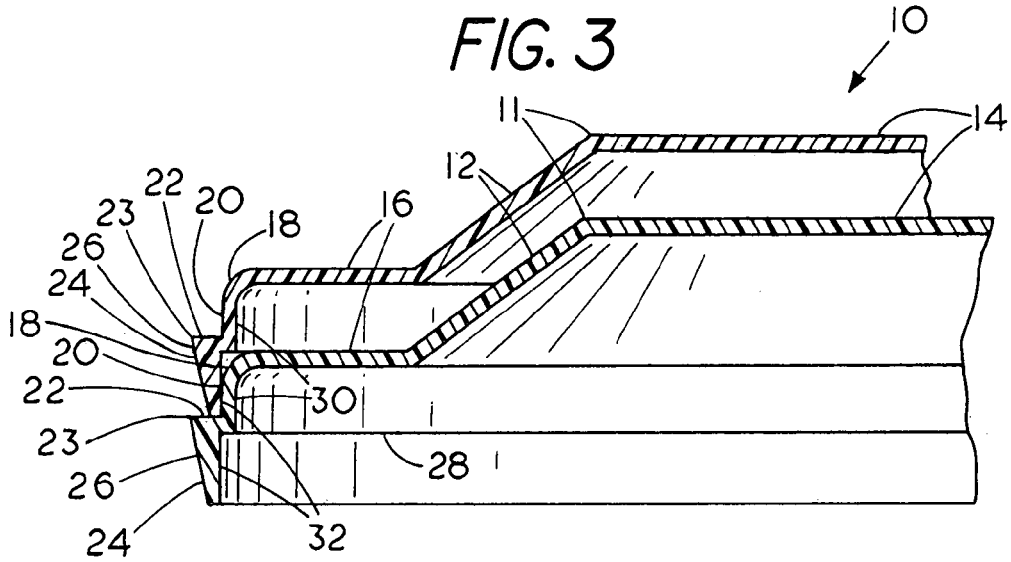
FIG. 3 is a view similar to FIG. 2 showing two of the discs in a stack.
Figure 4:
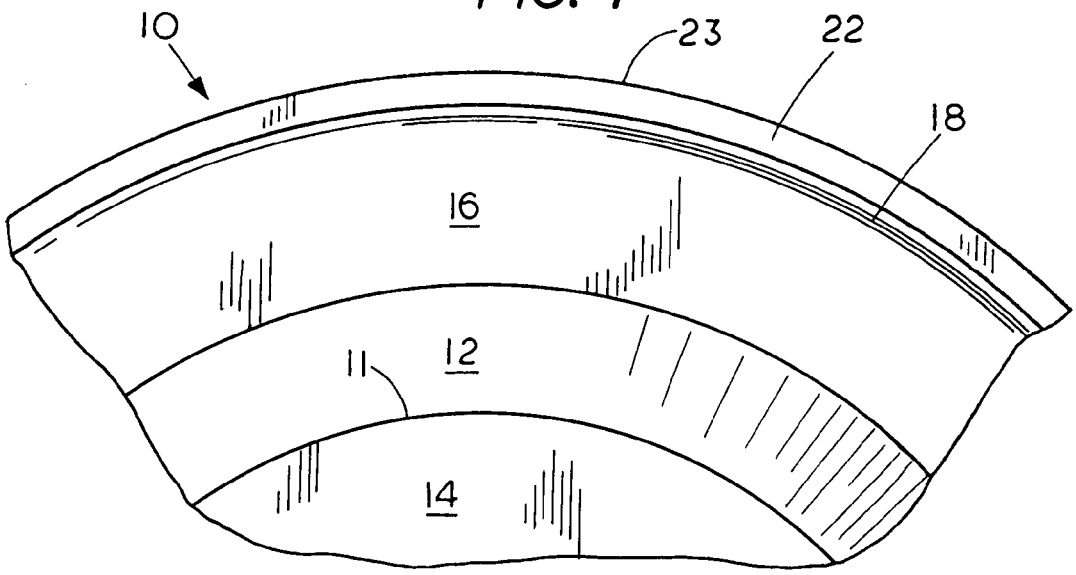
FIG. 4 is a partial top plan view of the invention.

The Figures illustrate by way of example a flying disc toy indicated generally by the numeral 10 which is formed from plastic resin, e.g., polyethylene or polypropylene having a flat circular center section 14 with a circular, downwardly inclined frustoconical apron portion 12 that intersects the center section 14 along a circular line 11. The central body portion of the disc 10 comprises the inclined apron 12 and the flat section 14. Surrounding the central body portion 12, 14 at the edge of the apron 14 is a rim 18 that can be thought of as having a stair-step cross-sectional configuration which has been found effective in rigidifying the rim as well as the entire disc. The wall of the disc typically has a thickness of about 1/16 inch and is of uniform thickness throughout, including the rim 18. The upper step includes a circular tread portion 16 and an upright annular riser portion 20. The lower step includes a circular tread portion 22 and an upright annular riser portion 26 that intersects along a shoulder defined by an edge 23. The outer surface of the lower riser 26 converges centrally at 24 toward the bottom or free edge of the rim 18. The entire structure of the disc is strengthened and rigidified by the steps which, as seen in FIGS. 2 and 3, act somewhat like two rigid angle irons connected together to resist bending in two mutually perpendicular directions. The under surface of the lower tread 22 forms an internal ledge 28. The inner surface of the upper tread is indicated at 30. It can be seen that the outside surface of the riser 20 is dimensioned slightly smaller than the inside surface 32 of the lower riser 26. In this way each of the lower risers is dimensioned to form a sliding fit over an outer surface of one of the upper risers 20 thus enabling the flying disc toys to be placed in a stable stack, i.e., one in which the discs are recessed, i.e., telescoped into one another. The resulting stack does not wobble and the stack can therefore be handled and packaged easily. When handled, the stack acts almost as a pillar with internal structural strength. Each riser is at least about 1/8 of an inch in height to about 3/16 of an inch in height and most preferably about 1/4 of an inch or more in height. It can also be seen in FIG. 3 that the lower edge of the rim is configured and dimensioned to fit into a right angle intersection between the outer surface of the upper riser 20 and the upper surface of the lower tread 22. When assembled the discs form a stable stack and have very good flight characteristics.

It was found that cooling tables previously used could be eliminated with the present invention and that the hot freshly molded discs could be removed from the molds and immediately placed in a stack (FIG. 3) of, say, a dozen discs and the entire stack inserted into a shipping carton with a single movement. The stacked product was found to be dimensionally self-stabilizing in the sense that dimensions were accurately maintained without distortion so as to thereby preserve excellent aerodynamic flight qualities and eliminate the problem of non-uniform printing caused by distortions that were previously encountered. Thus the invention enables the hot stacking of the discs immediately after removal from the molds to harden the discs without distortion. It will be noted that the wall thickness of the rim 18 including the steps is substantially uniform throughout, the same as the rest of the disc. It is contemplated that the term "substantially uniform" herein includes variations such as the difference in thickness of the lower riser 26.

It is important that the rim, which includes the steps, either maintains or enhances the aerodynamic flight characteristics of the disc. It was found that the invention exhibits excellent flight characteristics. It is theorized that the shoulder 23 may help to divide the streamlines as air passes around the upper and lower edges of the rim during flight. In addition, the two steps in the rim area provide extra vertical and horizontal surfaces which promote stability during flight. The invention also uses a minimum of resin and does not require thickened portions for stacking which would increase production costs because of the extra resin required.

Figure 5:
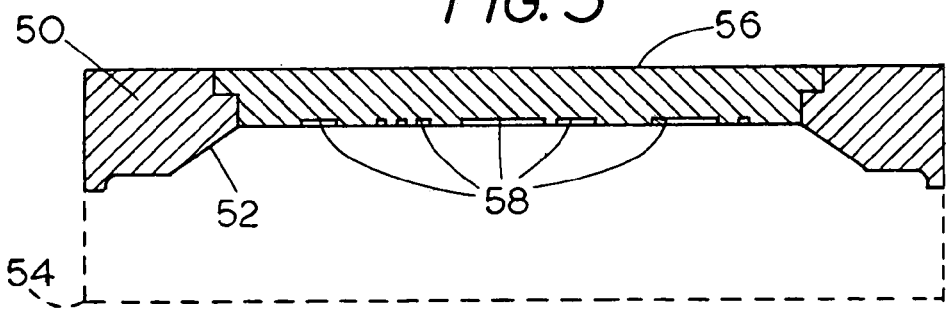
FIG. 5 is a diagrammatic central cross-sectional view of the upper half of a mold that can be used for forming discs in accordance with the invention.

As an alternative to screen printing, the top of the discs can be engraved with advertising material or other markings as shown in FIG. 5. FIG. 5 illustrates diagrammatically the upper half of one preferred form of molding die that can be used to form the present invention. The upper half of the mold indicated by the numeral 50 includes a lower molding surface 52 that is shaped to mold the top of the disc 10. The lower half of the mold is indicated generally at 54. At the center of the upper half 50 of the mold is a removable circular and replaceable molding insert 56. The insert 56 is engraved on its lower surface as shown at 58 to form letters, numbers, or other indicia for advertising or other purposes in the top of the disc 10. When a different advertising text is required, the insert 56 is simply removed and replaced with a similar insert 56 having a different engraved message 58 thereby making advertising changes for different customers simpler and less expensive.

Many variations of the present invention within the scope of the appended claims will be apparent to those skilled in the art once the principles described herein are understood.

What is claimed is:

1. A flying disc toy formed from plastic resin comprising, a circular central body portion, a circular downturned rim surrounding the body portion, the rim having a stair-step cross-sectional configuration to rigidify the rim and maintain flight characteristics, said rim including an upper step and a lower step peripherally thereof each having a circular tread portion and an upright annular riser portion that are at right angles to one another, an inner surface of the lower riser is dimensioned to form a sliding fit over an outer surface of the upper riser of a similar disc stacked beneath said disc, both risers have about the same height such that the discs form a stack when the discs are slid telescopically into one another a lower edge of the rim is configured and dimensioned to fit into a right angle intersection that is positioned between an outer surface of an upper riser and an upper surface of a lower tread of each disc and an outer surface of the lower riser is inclined so as to taper centrally proceeding toward a lower edge of the rim.

2. The disc of claim 1 wherein the circular central body portion is engraved on its upper surface with alphanumeric information or other indicia.

3. The disc of claim 1 wherein the disc is provided with indicia in the shape of a molding die having a removable insert that is engraved with said indicia.

4. A flying disc toy formed from plastic resin comprising, a circular central body portion, a circular downturned rim surrounding the body portion, the rim having a stair-step cross-sectional configuration to rigidify the rim and maintain flight characteristics, said rim including an upper step and a lower step peripherally of the upper step, each such step having a circular tread portion and an upwardly extending annular riser portion that have an angular intersection with one another, an inner surface of the lower riser is dimensioned to form a sliding fit over an outer surface of the upper riser of a similar disc stacked beneath said disc each riser having a height that enables the discs to form a stack when the discs are slid telescopically into one another, an outer surface of a lower riser is inclined so as to taper centrally proceeding toward a lower edge of the rim and a lower edge of the rim is configured and dimensioned to fit into said angular intersection that is positioned between an outer surface of an upper riser and an upper surface of a lower tread of each disc.

5. The disc of claim 4 wherein the central body portion has a flat circular center section surrounded by a frustoconical downwardly inclined apron that extends outwardly to the tread of said upper step.

6. The disc of claim 4 wherein a lower edge of the rim is configured and dimensioned to fit into a right angle intersection that is located between an outer surface of an upper riser and an upper surface of a lower tread of said disc.

7. The disc of claim 4 wherein the circular central body portion is engraved on its upper surface with alphanumeric information or other indicia.

8. The disc of claim 7 wherein the disc is provided with indicia in the shape of a molding die having a removable insert that is engraved with said indicia.

9. The disc of claim 1 wherein the body portion has a circular center surrounded by a frustoconical downwardly inclined apron that extends outwardly to the tread of said upper step.

* * * * *